US005918933A

United States Patent [19]

Hutchinson et al.

[11] Patent Number: 5,918,933

[45] **Date of Patent: *Jul. 6, 1999**

[54] BODY SUPPORT

[75] Inventors: James M. F. Hutchinson, Mohnton; Robert Tor Pike, Reading, both of Pa.

[73] Assignee: Graco Children's Products Inc., Elverson, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/880,796

[22] Filed: Jun. 23, 1997

Related U.S. Application Data

[63] Continuation of application No. 08/531,679, Sep. 21, 1995, abandoned.

[51] Int. Cl.[6] ..... A47C 31/00

[52] U.S. Cl. ..... 297/219.12; 297/397; 297/220; 297/229; 297/230.12; 128/869; 128/870

[58] Field of Search ..... 297/284.5, 284.9, 297/230.12, 452.35, 452.36, 219.12, 220, 229, 397; 5/636, 637, 643, 655; 128/846, 870, 869, 857

[56] References Cited

U.S. PATENT DOCUMENTS

| | | | |
|---|---|---|---|
| 969,251 | 9/1910 | Denzer | 297/397 |
| 2,267,103 | 12/1941 | Ireland . | |
| 2,306,334 | 12/1942 | Costas . | |
| 2,582,571 | 1/1952 | Thoma . | |
| 2,835,311 | 5/1958 | Reeves et al. . | |
| 3,148,389 | 9/1964 | Lustig | 5/643 |
| 3,159,426 | 12/1964 | Kerr . | |
| 3,761,126 | 9/1973 | Mulholland . | |
| 4,114,948 | 9/1978 | Perkey . | |
| 4,285,081 | 8/1981 | Price . | |
| 4,341,422 | 7/1982 | Cunningham . | |
| 4,383,713 | 5/1983 | Roston . | |
| 4,402,548 | 9/1983 | Mason . | |
| 4,440,443 | 4/1984 | Nordskog . | |
| 4,447,922 | 5/1984 | Brochu . | |
| 4,531,247 | 7/1985 | Eary, Sr. | 5/643 |
| 4,607,885 | 8/1986 | del Fierro . | |
| 4,707,031 | 11/1987 | Meistrell . | |
| 4,738,488 | 4/1988 | Camelio . | |
| 4,776,049 | 10/1988 | Perron . | |
| 4,779,930 | 10/1988 | Rosen . | |
| 4,838,611 | 6/1989 | Talaugon . | |
| 4,964,418 | 10/1990 | Wilson . | |
| 4,991,222 | 2/1991 | Nixdorf . | |
| 5,007,653 | 4/1991 | Chen . | |
| 5,064,245 | 11/1991 | Stephens . | |
| 5,106,158 | 4/1992 | Dukatz et al. . | |
| 5,108,152 | 4/1992 | Reilly et al. . | |
| 5,127,120 | 7/1992 | Mason . | |
| 5,129,705 | 7/1992 | Wray . | |
| 5,154,477 | 10/1992 | Lacy . | |
| 5,161,522 | 11/1992 | Clevenger . | |

(List continued on next page.)

*Primary Examiner*—Peter M. Cuomo
*Assistant Examiner*—Anthony D. Barfield
*Attorney, Agent, or Firm*—Richard B. O'Planick; Timothy A. Nathan

[57] ABSTRACT

A support adapted for infant holding devices, such as strollers, swing, seats, etc., includes an upper support and a lower support extending from the upper support. The upper support is adapted to support the upper portion of the body, including the head, and the lower support is adapted for supporting the lower portion of the body. The upper portion has a head support that includes a base member having a central support and left and right upper supports extending left and right of the central support. Each of the left and right supports has a pocket carrying a substantially rigid backing member. These backing members shape the left and right supports to a desired configuration for purposes of supporting opposite lateral portions of the head. In particular, each backing member is arcuate or semi-cylindrical, with a concave side and a arcuate backing member. The convex side provides the support area and enables the left and right supports to be easily angled about the central support so that they substantially face toward each other. A cushioning material is placed adjacent to the backing member.

23 Claims, 4 Drawing Sheets

U.S. PATENT DOCUMENTS 5,161,855 11/1992 Harmon .
5,163,195 11/1992 Hill .
5,205,611 4/1993 Stephens .
5,211,696 5/1993 Lacy .
5,216,772 6/1993 Clute .
5,220,700 6/1993 Liu .
5,228,745 7/1993 Hazel .
5,248,182 9/1993 Hittie .
5,272,780 12/1993 Clute .
5,310,245 5/1994 Lyszczasz .
5,339,472 8/1994 Yin .
5,361,430 11/1994 Wise .
5,382,078 1/1995 Lanteri .
5,383,711 1/1995 Houghteling .
5,441,328 8/1995 Snyder .
5,468,020 11/1995 Scime ..... 297/219.12
5,473,785 12/1995 Lager et al. ..... 5/655
5,535,468 7/1996 Mallernee ..... 5/643

FIG. 6
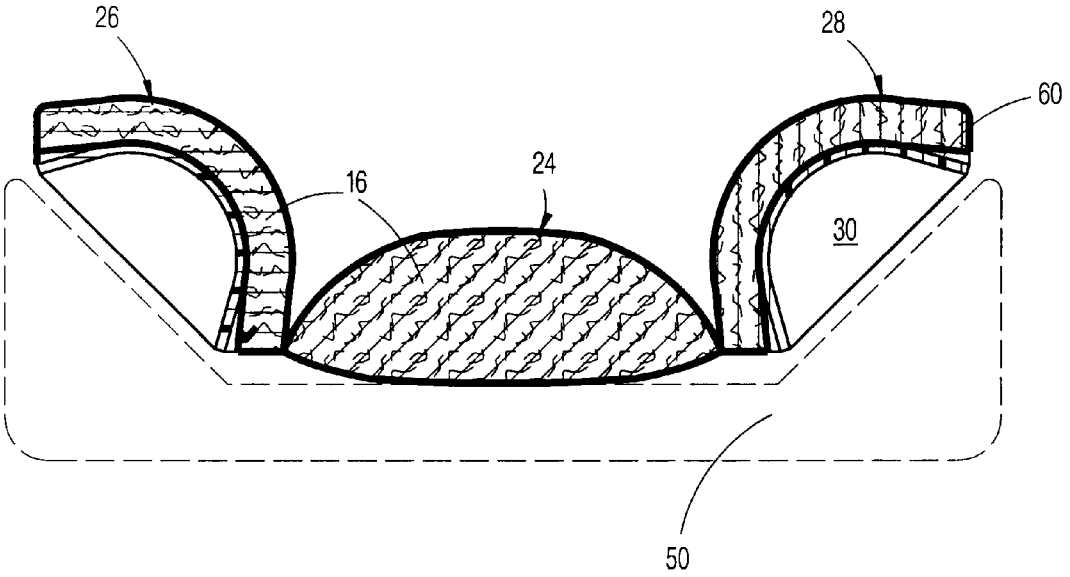
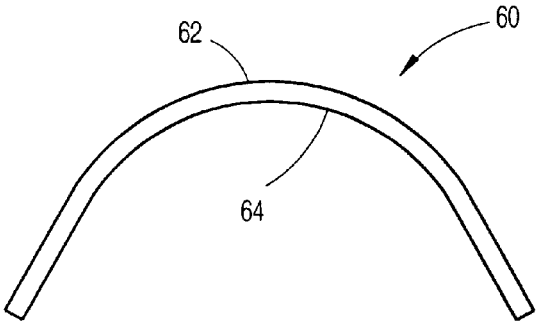
FIG. 3

BODY SUPPORT

This application is a continuation of application Ser. No. 08/531,679, filed Sep. 21, 1995, now abandoned.

BACKGROUND

Prior art teaches numerous approaches for restraining a person's upper body, in particular, to restraining an infant's head during transport in strollers, car seats, infant carriers, swings, cribs, bassinets, bouncer seats, high chairs, etc. For example, head restraining supports are disclosed in U.S. Pat. Nos. 5,383,711 to Houghteling; 5,339,472 to Yin; 5,310,245 to Lyszczasz; 5,272,780 to Clute; 5,248,182 to Hittie; 5,228,745 to Hazel; 5,220,700 to Liu; 5,211,696 and 5,154,477 to Lacy; 5,161,855 to Harmon; 5,161,522 to Clevenger; 5,127,120 and 4,402,548 to Mason; 4,838,611 to Talaugon; 4,779,930 to Rosen; 4,738,488 to Camelio; and 4,383,713 to Roston.

The Houghteling patent, in particular, discloses an infant head support attached to a liner sheet or to a rectangular base member. This liner sheet or base member, which is placed on an infant carrier or seat, is padded and dimensioned at least partially to underlie the infant's upper body. A pair of laterally spaced rectangular head support members, which form the head support, are attached directly to the liner sheet or rectangular base member. These rectangular head support members, made of resilient cushion having no internal frame, are rolled or folded so that they support opposite lateral portions of the infant's head. The Lyszczasz, Harmon, and Clute patents describe similar structures.

The Mason ('548) and Clevenger patents describe another type of head supports, where the head supporting members are adjustably or slidably attached directly to the back of a seat. The Lucy patents describe similar head supports, a single-cushion pillow type attached to a head rest or a seat back. Another example of a single cushion pillow type, which directly rests on the infant's or child's neck, is described in the Yin, Talaugon, and Camelio patents. Further, a conformal body or head pad type is disclosed in the Roston, Rosen, Mason ('120), and Hazel patents.

SUMMARY

The present invention relates to a support, and more particularly to a head support, adapted for infant holding devices, such as strollers, swings, carriers, car seats, cribs, bassinets, bouncer seats, high chairs, etc. According to the present invention, the support has a flexible base member, which has a lower support extending below an upper support. The upper support supports the upper body, including the head, and the lower support supports the lower body. One way the present support can be used is with a seat having a seat portion and a back-rest portion, where the upper support rests on the back-rest portion and the lower support on the seat portion. The present support can also be used with a seat having a side arm. In this regard, the lower support has left and right extensions extending left and right of the lower support. These extensions are designed to wrap or loop around the side arms.

The upper support includes a head support, where spaced apart, substantially rigid, removable and reversible backing members are inserted. At least one pocket is preferably formed behind the upper portion of the upper support, where the infant's head normally rests. Preferably, the base member has two discrete pockets, each holding a backing member. Specifically, the upper support has a central support and left and right supports extending left and right of the central support. A pocket is formed on each of the left and right supports and each pocket holds one of the backing members. These backing members shape the left and right supports to a desired configuration for purposes of supporting opposite lateral portions of the head. In particular, the left and right supports can be angled about the central support so that they substantially face toward each other. Furthermore, when the reversible supports have cylindrical shapes, different levels of support can be provided.

Preferably, each backing member is arcuate or semicylindrical, with a concave side and a convex side. While the backing member can be made of any material, it is preferably made of a plastic material, such as polypropylene. Although a cushion is only needed adjacent the pockets where the infant's head rests, it is preferable to include a cushion throughout the upper and lower supports.

BRIEF DESCRIPTION OF THE DRAWINGS

These and other features, aspects, and advantages of the present invention will become much more apparent from the following description, appended claims, and accompanying drawings where:

FIG. 3 is an end view of the backing member.

FIG. 6 is similar to FIG. 5 in an angled use position.

FIG. 7 is similar to FIG. 6 with the left and right support portions substantially facing each other.

DETAILED DESCRIPTION OF THE DRAWINGS

Figure 1:
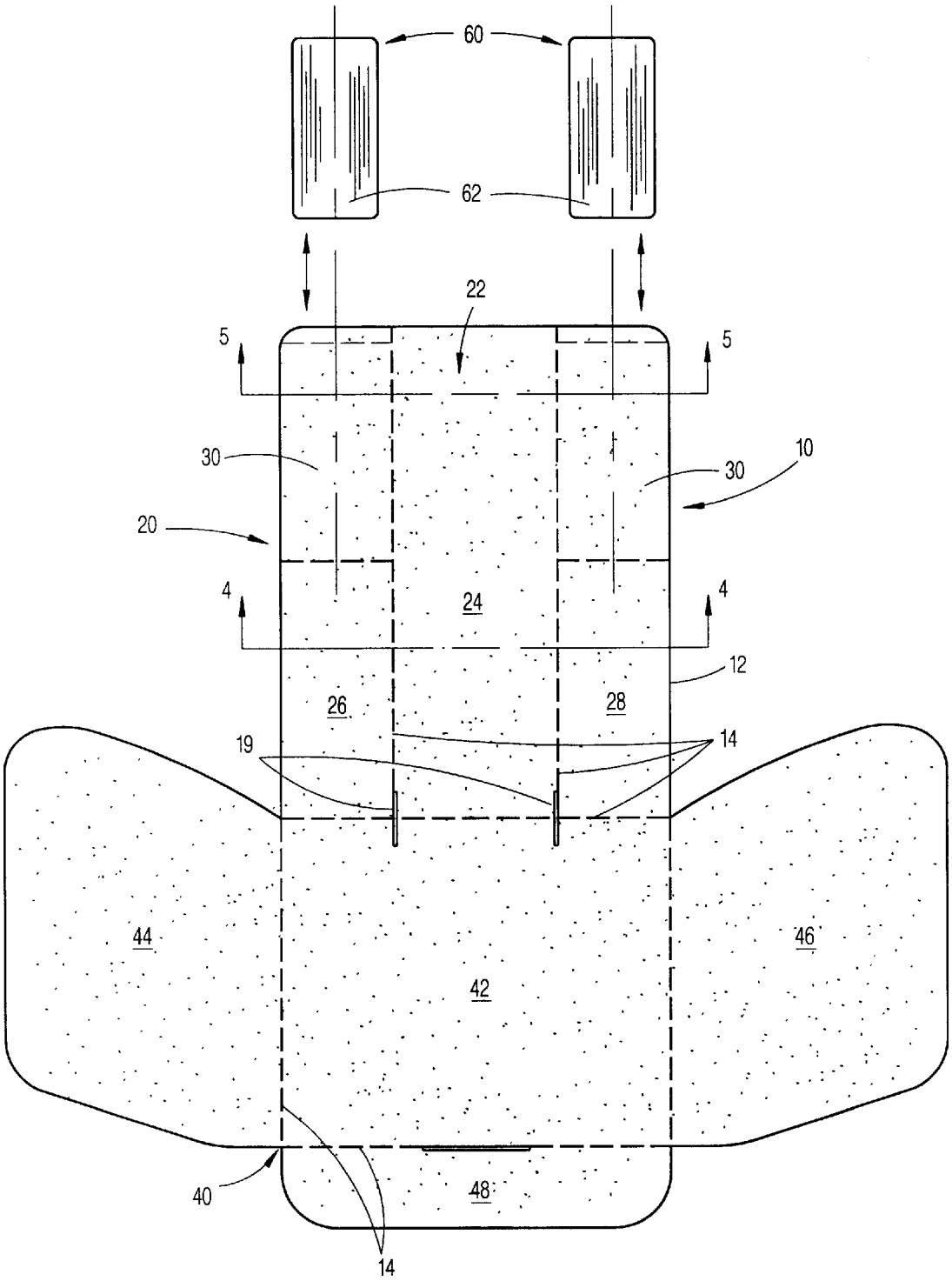
FIG. 1 is a front plan view of the support according to the present invention, in a laid-flat position, with the backing member removed.
Figure 2:
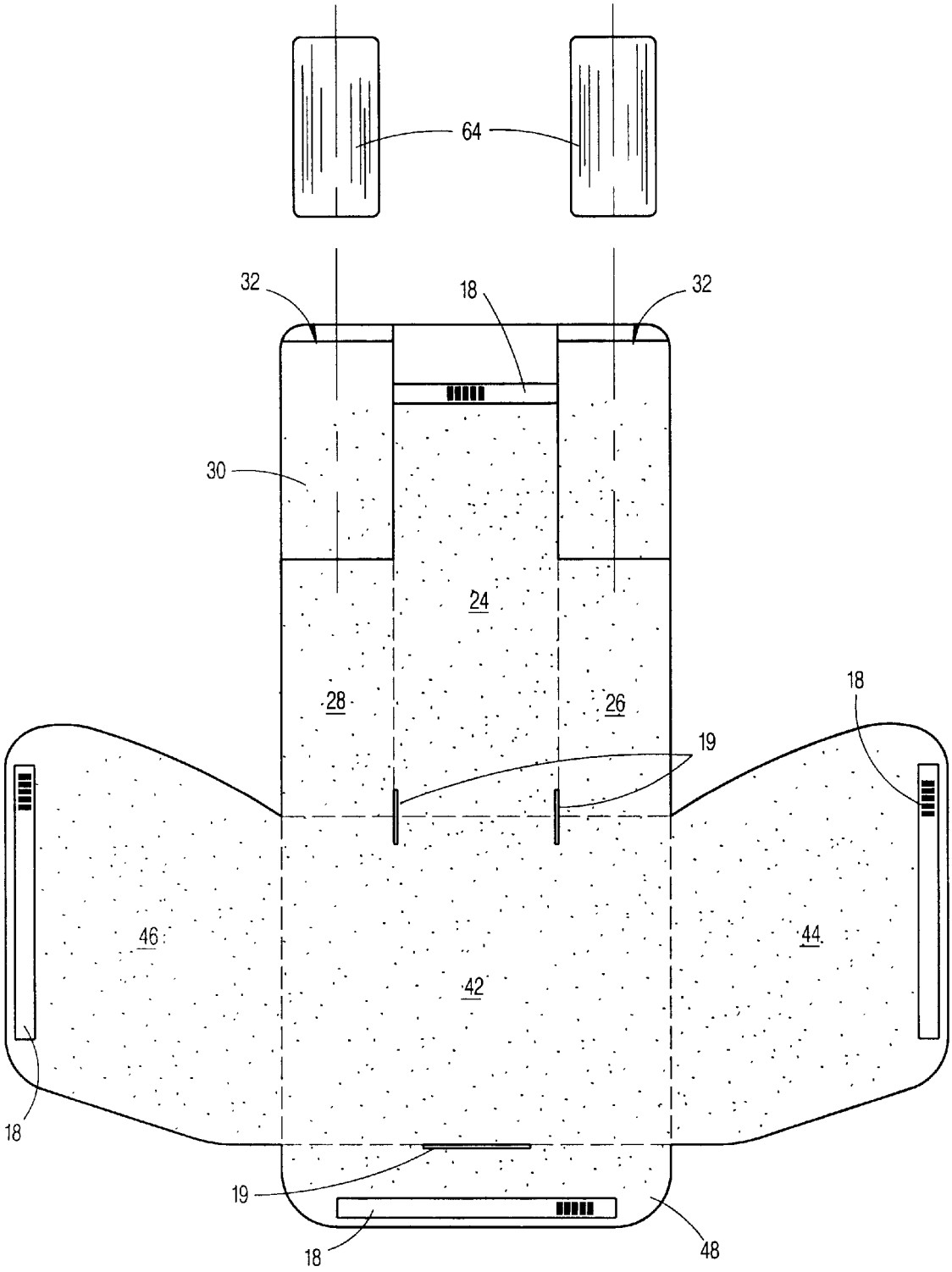
FIG. 2 is a back plan view of the support shown in FIG. 1.

Referring to FIGS. 1 and 2, a support 10 has a flexible base member 12 that includes a lower support 40 extending below an upper support 20. The upper support 20 has a head support 22 in an area where an infant's head would normally lie in a seating or lying position. The head support has a central support 24 and a left upper support 26 and a right upper support 28 extending left and right of the central support 24. Each of the left and right support has a pocket 30 for holding a substantially rigid backing member 60. When the backing members are inserted into the pockets, the flexible left and right supports conform to the backing member's shape. According to the present invention, as better shown in FIG. 3, the backing-member 60 is preferably arcuate or semicylindrical, forming a convex side 62 and a concave side 64, the shape being to configure the left and right support portions so that they substantially face toward each other or become easily manipulated into a bottom-truncated V-shape, the configuration shown in FIGS. 6 and 7, where the left and right supports are angled about the central support.

The lower support 40 has a seat portion 42 and left and right wings or extensions 44, 46 extending left and right of the seat portion and extending preferably upperly, as shown in FIGS. 1 and 2. These extensions 44, 46 are designed to wrap or loop around the side arms of the seat and secured to the seat using conventional fasteners such as hook and pile pads 18 (i.e. VELCRO) provided on the back side of the extensions. In addition, a lower flap portion 48, which extends below the seat portion 42, can be included. This flap portion can wrap around the front edge of the seat and attach underneath the seat using a hook and pile pad 18.

Referring to FIG. 2, the support has at least one additional hook and pile pad 18 on the back of the head support for attaching to a backing support 50, such as a seat back-rest. The support also can be provided with slits 19 or the like to enable safety straps or belts to pass through it.

Although the support 10 depicted in the present invention is shaped for use with a stroller having side arms, it can also be shaped for use with an infant car seat, as well as any other child or infant holding devices using hook and pile pads or the like, for attachment to an appropriate fabric cover. Alternately, the cushion 10 could have elastic bands that stretch-fit over the infant holding devices. Other attachment devices, including snaps and tie strings, can be included for various applications of the present support.

FIG. 6 shows the head support positioned for use, where the left and right head support portions 26 and 28 are angled about the central support portion 24. In this regard, a backing support 50, such as a back-rest of a seat, can be provided with means for angling or maintaining the left and right support portions angled about the central support. The degree of angling can be adjusted as desired to provide a desirable degree of head stabilization. The backing members 60 can even be removed entirely from the base member 12, allowing the pockets to collapse, thereby providing more freedom of movement for the infant's head, yet with some support from the underlying cushioning. Additionally, the degree of angling can be adjusted by inserting backing-member 60 into pocket 30 with convex side 62 opposite of the padding as shown in FIG. 7, so that an degree angling different than that shown in FIG. 6 can be achieved.

The supports can have different shape than the ones shown, including a cylindrical backing member, which shape will support the infant's head. In this regard, the pockets 30 can be formed of a stretchable material so that differently sized or shaped backing members can be inserted. And although the pockets each can be left with an opening 32 used to insert and remove these backing members, they can have closures such as zippers, buttons, flaps, etc., to better retain them in place. Further, the backing members can even be placed permanently inside the cushion, without needing the pockets.

While the backing members 60 can be made of any substantially rigid material for purposes of shaping the head support, it is preferable for them to be formed of a substantially rigid plastic material, such as sheet plastic, hard foam plastic, or similar lightweight supporting material. One preferable material is polypropylene.

Figure 4:
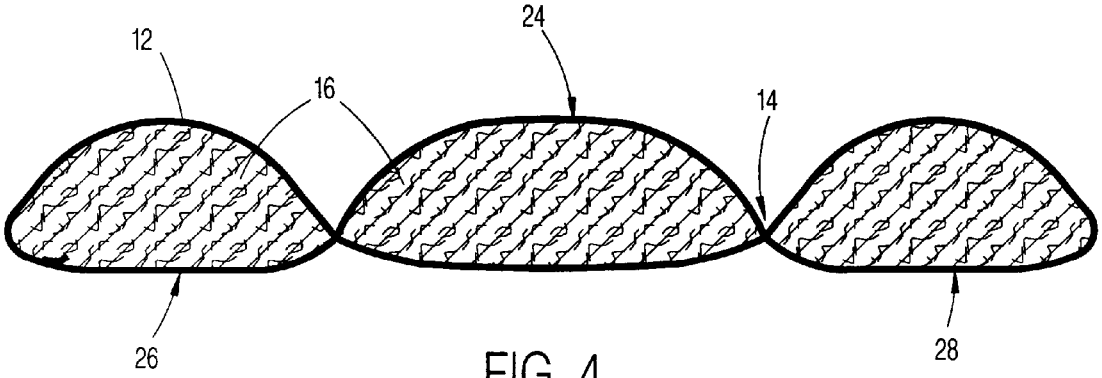
FIG. 4 is a cross-sectional view taken along line 4—4 of FIG. 1.
Figure 5:
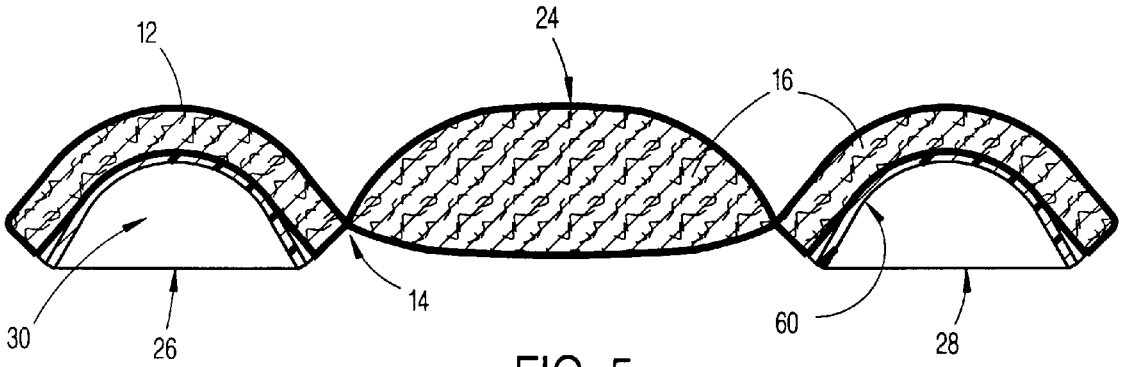
FIG. 5 is a cross-sectional view taken along line 5—5 of FIG. 1, with the backing members inserted in the pockets and the support held in a substantially flat position.

Referring to FIGS. 4–6, the entire support 10 is preferably made, for example, of a cotton cover 12, stitched 14 in a quilt fashion over a cushioning material 16, which can be any conventional material such as fibers, down, foam pad, etc. The support according to the present invention is removable to allow washing and ready replacement, by having an elastic peripheral band, or a plurality of straps, tie strings, or hook and pile pads. The support also can be made to fit over a variety of infant holding devices.

Given the present disclosure, one versed in the art would readily appreciate that there may be other embodiments and modifications well within the scope and spirit of the present invention. Accordingly, all expedient modifications readily attainable by one versed in the art from the present disclosure within the scope and spirit of the present invention are to be included as further embodiments of the present invention. The scope of the present invention accordingly is to be defined as set forth in the appended claims.

We claim:

1. A support adapted for supporting a person, the support comprising:

an upper support adapted to support an upper portion of the person, including the head, wherein the support has a central support and left and right upper supports extending left and right of the central support;

a substantially, rigid backing member removably received in a pocket formed on each of the left and right upper supports, wherein each said backing member is adapted to support the head, wherein said backing members are adapted to be accessible to a user, and wherein each backing member has an arcuate outer body defined by a concave side and a convex side extending between two ends thereof; and a lower support extending at least from the central support and adapted to seat the lower portion of the person.

2. A support according to claim 1, wherein the upper and lower supports are adapted for positioning on a seat having a seat portion and a back portion such that the upper support is on the back portion and the lower support is on the seat portion and such that the left and right supports are angled relative to the central support so that they substantially face toward each other.

3. A support according to claim 2, wherein the lower support comprises a seat portion and left and rights extension extending left and right of the seat portion of the lower support, and wherein the seat portion of the lower support is adapted for use with a seat having side arms such that the left and right extension of the lower support are adapted for covering the side arms of the seat.

4. A support according to claim 1, wherein the surface of the concave side of each backing member substantially follows the surface of the convex side of that backing member.

5. A support according to claim 4, wherein at least each of the left and right upper supports includes a cushion facing the convex side of the respective backing member.

6. A support according to claim 5, wherein at least each of the left and right upper supports includes a cushion facing the concave side of the respective backing member.

7. A support according to claim 1, wherein each backing member is semi-cylindrical and formed of a plastic material.

8. A head support comprising:

a base member adapted for supporting a user's head;

at least one pair of pockets formed on the base member in an area for supporting the user's head and; a pair of substantially spaced apart rigid backing members each of the rigid backing members being removably positioned in a respective one of the pockets for supporting a user's head, and each of the rigid backing members being arcuate and having an outer surface, the outer surface having a concave side and a convex side.

9. A head support according to claim 8, wherein the base member has two discrete pockets and two discrete substantially rigid backing members, each removably positioned in one of the pockets.

10. A head support according to claim 9, wherein the surface of the concave side of each backing member substantially follows the surface of the convex side of that backing member.

11. A head support according to claim 10, wherein the abase member includes a cushion on at least each of the pockets, wherein the cushions face the convex sides of the backing members.

12. A head support according to claim 10, wherein the base member includes a cushion on at least each of the pockets, wherein the cushions face the concave sides of the backing members.

13. A head support according to claim 9, wherein each of the two backing members is semi-cylindrical formed of a plastic material.

14. A head support according to claim 13, wherein the base member has a central support and left and right supports extending left and right of the central support, wherein the pockets, each holding one of the backing members, are located on the left and right supports.

15. A head support according to claim 14, wherein the base member is adapted for use with a seat having a back portion and a seat portion such that the central support and the left and right supports of the base member are positioned on the back portion of the seat and such that the backing members of the head support adapted to substantially face toward each other.

16. A support adapted for supporting a person, the support comprising:

an upper support adapted to support an upper portion of the person, including the head, wherein the upper support has a central support and left and right upper supports extending left and right of the central support;

a substantially rigid backing member positioned in a pocket formed on each of the left and right supports, and adapted to support the head, wherein each backing member is arcuate, with a concave side and a convex side; and a lower support extending at least from the central support and adapted to seat a lower portion of the person.

17. The support according to claim 16, wherein a pocket is formed on each of the left and right supports for containing the backing member.

18. The support according to claim 10, wherein each backing member is semi-cylindrical.

19. The support according to claim 16, wherein the base member includes a cushion on at least each of the pockets, wherein the cushions face the concave sides of the backing members.

20. The support according to claim 16, wherein the base member includes a cushion on at least each of the pockets, wherein the cushions face the convex sides of the backing members.

21. The support according to claim 16, wherein the substantially rigid backing member is removably positioned in each of the pockets of the left and right upper supports.

22. The support according to claim 16, wherein the surface of the concave side of each backing member substantially follows the surface of the convex side of that baking member.

23. The support according to claim 16, wherein the substantially rigid backing member is reversibly positioned with respect to its concave and convex sides in each of the left and right upper supports.

* * * * *